United States Patent [19]

Freeman

[11] Patent Number: 4,757,577

[45] Date of Patent: Jul. 19, 1988

[54] MULTI-WAY SLIDE FASTENER AND STRUCTURAL SUPPORT

[76] Inventor: William Freeman, 23 Warwick Rd. #1, Brookline, Mass. 02146

[21] Appl. No.: 903,218

[22] Filed: Sep. 2, 1986

[51] Int. Cl.[4] ..... A44B 19/02

[52] U.S. Cl. ..... 24/382; 24/411

[58] Field of Search ..... 24/382, 383, 386, 387, 24/399, 403, 411; 52/108

[56] References Cited

U.S. PATENT DOCUMENTS

| | | | |
|---|---|---|---|
| 1,891,989 | 12/1932 | Johnson | 24/411 |
| 2,178,885 | 11/1939 | Buff et al. | 24/382 |
| 2,483,057 | 9/1949 | Levering | 24/382 |
| 3,213,573 | 10/1965 | Bohr et al. | 52/108 |
| 3,242,576 | 3/1966 | Wheeler | 52/108 |
| 4,112,552 | 9/1978 | Lee | 24/382 |
| 4,485,534 | 12/1984 | Pilie et al. | 24/382 |

FOREIGN PATENT DOCUMENTS

| | | | |
|---|---|---|---|
| 1014492 | 1/1958 | Fed. Rep. of Germany | 24/382 |
| 1063547 | 8/1959 | Fed. Rep. of Germany | 24/382 |

*Primary Examiner*—Victor N. Sakran

*Attorney, Agent, or Firm*—Cesari & McKenna

[57] ABSTRACT

This invention relates generally to fasteners, and more particularly to slide fasteners, commonly known as zippers, and a method of forming the same, which may be used to fasten three or more sets of links together, as well as, to provide a collapsible, rigid support for loads which may be applied axially and laterally to the fastened together links. The invention is easily stored and uses a single slider for interlocking the separate sets of elements in a simple and effective manner. The tapes have multiple links secured thereto and extend orthogonally therefrom. The slider has guideways through which the links may pass. The tapes and the links are passed downward through the slider element to thereby intersperse and interlock the links and thus the tape. The opposite movement through the slider causes the links to be separated and disjoined. The invention also includes a slide fastener having three tapes with essentially standard slide fastener links attached thereto and a slider which intersperses the links to join the tapes in a columnar fashion and which effectively disjoins the links.

16 Claims, 4 Drawing Sheets

MULTI-WAY SLIDE FASTENER AND STRUCTURAL SUPPORT

BACKGROUND OF THE INVENTION

This invention relates generally to fasteners, and more particularly to slide fasteners, commonly known as "zippers", and a method of making the same, which may be used to fasten more than two sets of teeth or links together. The invention may also be used to provide a collapsible, rigid support for loads which may applied axially and laterally to the fastened links. The invention may further be used to provide a means for joining two sets of elongated links together.

Slide fasteners or zippers, which can be used to attach an edge of a piece of sheet material to an edge of another piece of sheet material, are well known. In such, each of the edges to be fastened together has a row of teeth or links. A slider tool is drawn over the teeth to enable them to lock together.

In addition, slide fasteners for fastening three pieces of sheet material are known, as shown in U.S. Pat. Nos. 2,483,057 to Levering and 4,112,552 to Lee. In these fasteners, one piece of sheet material has mounted along one edge a set of double-sided teeth, with each side of the double-sided teeth fastening to single-sided teeth mounted on one edge of each of the other two pieces of sheet material. A single slider is disclosed in these patents for enabling the fastening of the single-sided teeth with the central dual-sided teeth.

In addition, it has been known to make collapsible structural members, such as disclosed in U.S. Pat. No. 3,213,573 to Bohr et al. In the Bohr et. al. patent, a complicated apparatus including peeler drums and peeler rollers is disclosed for interlocking and unlocking solid strips of material having interlockable edges.

SUMMARY OF THE INVENTION

An object of this invention is to provide a threeway fastener that can be used to join three separate pieces together simultaneously with substantially similar links.

Another object of this invention is to provide a threeway slide fastener that can be used as a structural support in a variety of cases.

Yet another object of this invention is to provide a method for joining and disjoining a multi-way slide fastner.

A further object of this invention is to provide a multi-way slide fastener having substantially similar shaped links which are selectively joined and disjoined by a single slider.

In brief, the new fastener includes a slider element and three separate tapes. Each of the tapes has multiple links secured thereto and extending orthogonally therefrom. The ends of the links are toothed. The slider element slides over the toothed ends of the links causing them to lock together to form a generally triangular shaped structure. The slider element has guideways for accepting and reorienting the links so that the links may be urged into and from the interlocking position.

An alternative embodiment of the invention comprises three tapes having essentially standard slide fastener links attached thereto and a slider which removably joins and disjoins the links in a columnar arrangement.

A further embodiment of the invention comprises two tapes having elongated links and an elongated slider which joins and disjoins the links in a lineal stacked arrangement.

BRIEF DESCRIPTION OF THE DRAWINGS

Further explanation of this invention is illustrated in detail in accordance with the accompanying drawings as follows.

DETAILED DESCRIPTION OF THE PREFERRED EMBODIMENTS

Figure 1:
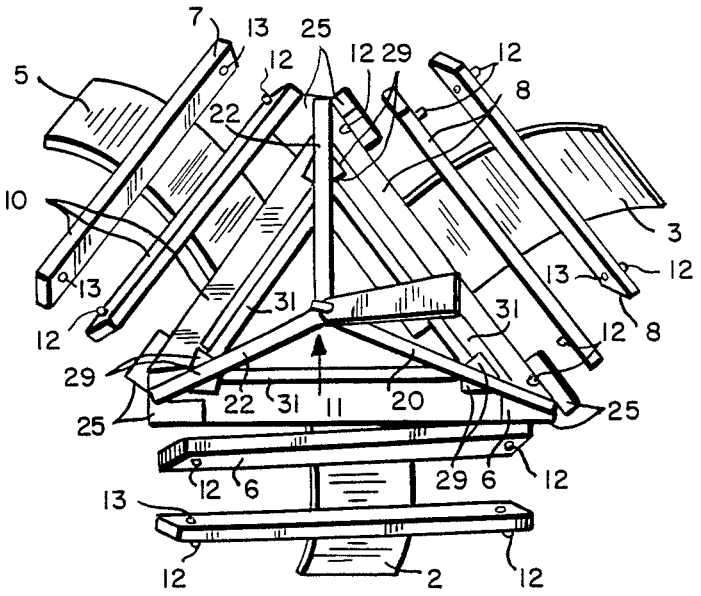
FIG. 1 is a top perspective view of a three-way slide fastener of the present invention.
Figure 2:
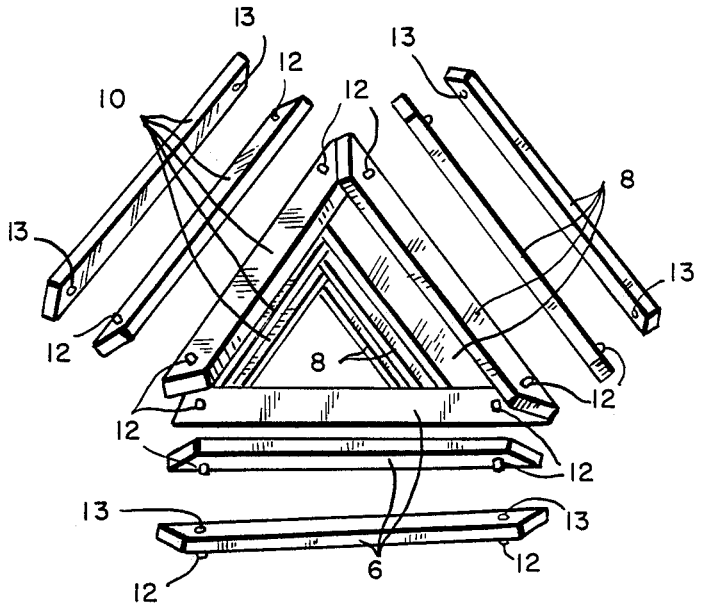
FIG. 2 is a perspective view similar to FIG. 1 with the tapes and slider removed therefrom for clarity.

With reference to FIGS. 1 and 2, three-way fastener 1 constructed in accordance with the present invention has three tapes 2, 3, and 5. Each of the tapes 2, 3, and 5 have secured thereto a plurality of elongated members, or links, 6, 8, and 10, respectively. The links 6, 8, and 10 extend orthogonally from the tapes 2, 3, and 5.

The links are secured to each of the tapes at preselected distances and are of a preselected size. The links 6 are sized and positioned on the tape 2, so that one end of the links 6 are adapted to mesh with one end of the links 8, which are appropriately sized and positioned on the tape 3. The links 6 are also sized and positioned on the tape 2 so that the other end of the links 6 are adapted to mesh with the other end of the links 10 which are appropriately sized and positioned on the tape 5. Likewise, the links 8 and 10 are sized and positioned on the tapes 3 and 5, so that the other ends of the links 8 and 10 are adapted to mesh with each other.

The tapes 2, 3, and 5 extend through a slider 11. As more fully explained below, the slider 11, as it is drawn over the links 6, 8, and 10 on the tapes 2, 3, 5, successively urges the ends of the respective links to intermesh. Likewise, the slider 11, as it is moved in the opposite direction with respect to the tapes, urges the links to separate from the meshed position. Thus, the tapes, or more specifically the ends of the links, may be selectively joined and disjoined.

With reference to FIG. 2, each of the links 6, 8, 10 are provided with interlocking teeth 12 positioned at both ends of the top surface and corresponding recesses 13 provided at both ends of the bottom surface. The teeth 12 are sized for positioning within the recesses 13 when the ends of the links are intermeshed to thereby interlock the links together.

Therefore, one of the respective ends of the links 8 intermesh with one of the respective ends of the links 6, such that the teeth 12 on the one end of the links 8 extend into the recesses 13 in the one end of the links 6, and the teeth 12 on the one end of the links 6 extend into the recesses 13 in the one end of the links 8. Further, the teeth 12 on the other end of the links 8 extend into the recesses 13 in one of the respective ends of the links 10, and the teeth 12 on the one end of the links 10 extend into the recesses 13 in the other end of links 8. Likewise the teeth 12 on the other end of the links 6 extend into the recesses 13 in the other end of the links 10, and the teeth 12 on the other end of the links 10 extend into the recesses 13 in the other end of the links 6. This arrangement thus, permits the formation of the triangular structure having the three sets of links 6, 8, and 10 interlocked with each other wherein the links are successively stacked one after the other.

Figure 3:
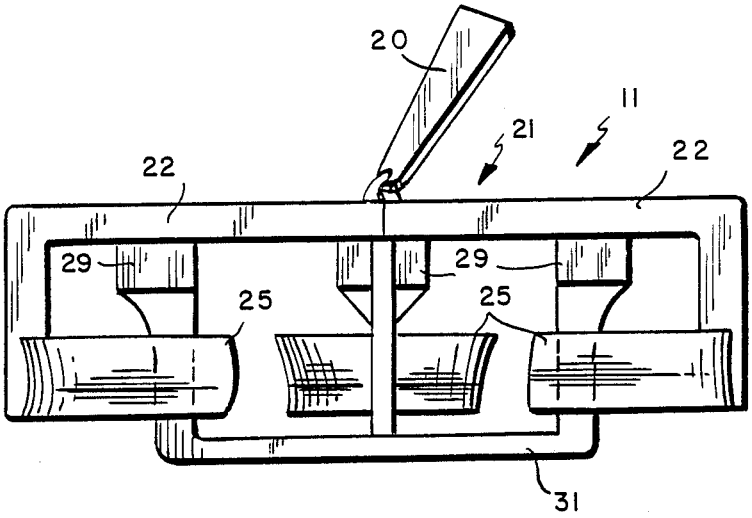
FIG. 3 is a side view of the slider.
Figure 4:
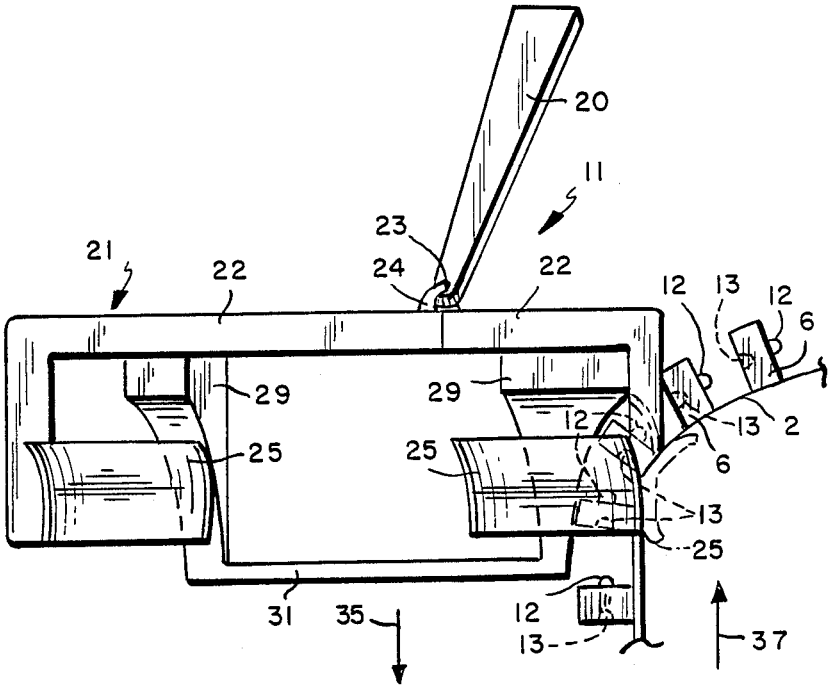
FIG. 4 is a side perspective of the slider with one tape extending therethrough.

With reference to FIGS. 3 and 4, the slider 11 is provided with a handle 20. The handle 20 is secured to a support 21, having three elongated members 22, by an aperture 23 in the handle 20 and a corresponding ring member 24 secured to the support 21. Two curved guide members 25, having a convex inner face portion, extend from each of the three ends of said elongated support members 22. Three dual-sided inner guide members 29, each having two concave outer face portions, are secured to the structural support 21. Each guide member 25 is positioned opposite one side of one of the inner guide members 29. Thus, there are three guideways which include two guide members 25 and one outer face portion of two adjacent inner guide members 29. The guide members 25 and 29 are so arranged that two of each of the guide members 25 and 29 contact each of the links 6, 8, and 10 that are disposed in each of the guideways. In one specific embodiment, rods 31 are secured to the guide members to provide structural strength and support to the guide members 29 and the slider 11, itself.

Thus, with particular reference to FIGS. 1 and 4, it will be appreciated that the tapes extend through the slider 11 with the links secured to the respective tapes being positioned between the two sets of inner and outer curved guide members. As illustrated in FIG. 4, the tape 2 with links 6 secured thereto is positioned in the slider 11. Each of the links 6 upon passing through the guideway defined by the guide members 25 and 29, in the direction indicated by arrow 35, tend to swivel slightly into an upright position to facilitate the interlocking of the adjoining links secured to the other tapes 3 and 5 (not shown in FIG. 4). In the same manner, the links 8 and 10 of the tapes 3 and 5 are oriented by the guide members 25 and 29, as they are directed through the slider 11, to thereby interlock with links on the other tapes. Conversely, by moving the tapes in the direction indicated by arrow 37, the links tend to swivel consecutively from their interlocked positions to a disengaged position and thus, are disjoined thereby.

It will be appreciated that the links will be better adapted for intermeshing, when using the interlocking teeth and depressions of the above disclosed embodiment, if the links are provided with a differential cross sectional thickness along the length of the links. By proper adjustment of this differential thickness, the ends of the links which intermeshed can be made substantially planar to thereby promote the interlocking of the teeth in the recesses.

This differential thickness allows for the differing heights of interspersed links which are interlocked. For example, each pair of consecutively spaced links 6 have one each of the links 8 and 10 disposed between them when the links are intermeshed and the links 8 and 10 are intermeshed as well, therefore, if no differential in the cross sectional thickness is provided in the links, the meshing ends of the links would intersect each other in a somewhat askew manner. Thus, this, in certain cases, may be a problem which can be easily overcome by changing the cross sectional thickness of the links along the length of the links.

Figure 5:
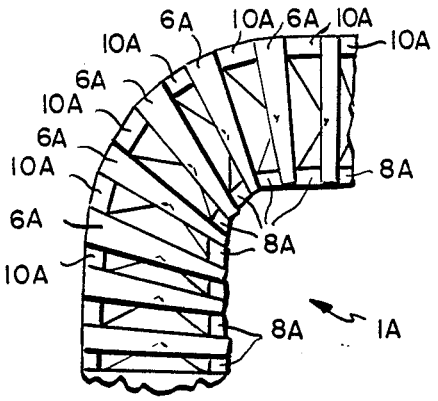
FIG. 5 is an alternative feature of the slide fastener of FIG. 1.

FIG. 5 depicts use of the new fastener to fasten materials having curvilinear edges together and to make curvilinear structural supports. In this embodiment, the differential sizing of the links is advantageously exploited by further increasing the differential along the length of selected links. A fastener 1a is shown having links **6*a*, 8*a*, and 10*a*. For clarity, FIG. 5 does not show the slider or tapes on which the links are secured, but they would be present in an actual embodiment. The links 6*a*, 8*a*, and 10*a* are not uniformly shaped. The ends of the links 6*a* and 10*a* which interlock are thicker than the ends of the links 6*a* and 8*a* and the ends of the links 8*a* and 10*a*** (not shown) which interlock. As will be appreciated, this arrangement permits the resulting structural support or fastener to have a curve or combination of curves while being joined together in the above-described manner. This feature may be especially useful in forming structural supports including supporting members for portable or collapsible chairs and the like. Further, this embodiment is useful in joining several corresponding nonlinear materials together.

Figure 5A:
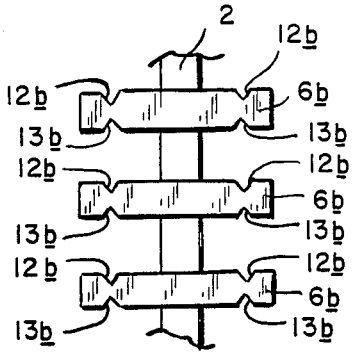
FIG. 5A is an alternative link for use with a slide fastener of the type shown in FIG. 1.

FIG. 5A depicts a tape **2*b* to which links 6*b* are secured. The links are provided with interlocking notches 12*b* at both ends in the top surface and corresponding notches 13*b* at both ends in the bottom surface of the links. It will be appreciated that two other tapes having links secured thereto together with tape 2*b* can be used in practicing the present invention. In this arrangement the links are intermeshed by use of the slider shown in FIG. 3** and are interlocked by the coupling of the upper and lower notches in the intermeshed links.

Figure 6:
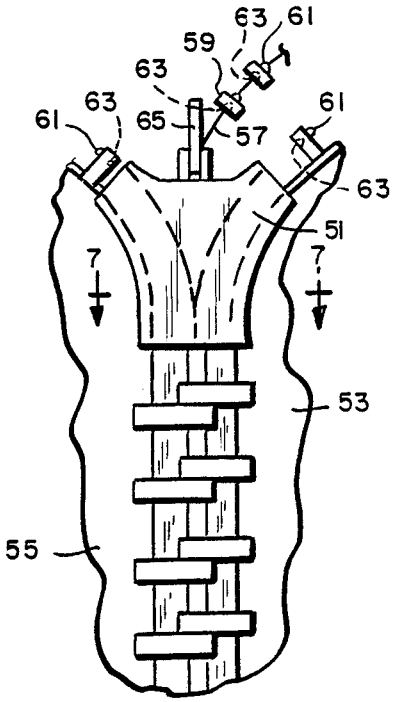
FIG. 6 is an alternative embodiment of the present invention.
Figure 7:
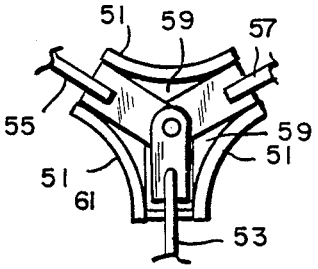
FIG. 7 is a cross-section of the embodiment of FIG. 6 taken along the line 7—7.

With reference to FIGS. 6 and 7, an alternative embodiment of the present invention is shown with a slider 51 having three tracks 52 through which three tapes 53, 55, 57 extend therethrough. The tapes have links 59 regularly secured thereto. The links are provided with corresponding teeth 61 and recesses 63. The tracks 52 are formed so that, upon movement of the slider up the tapes, the teeth of the tapes are urged to swivel to successively intermesh the links 59 of the tapes 53, 55, and 57. The links 59 of each of the tapes 53, 55, and 57 are interlocked as the tooth 61 on each successive one of the links 59 extend into the recess 63 on the above positioned link on a different tape. The movement of the slider 51 is facilitated by a handle 65 which is secured to the slider 65.

Figure 8:
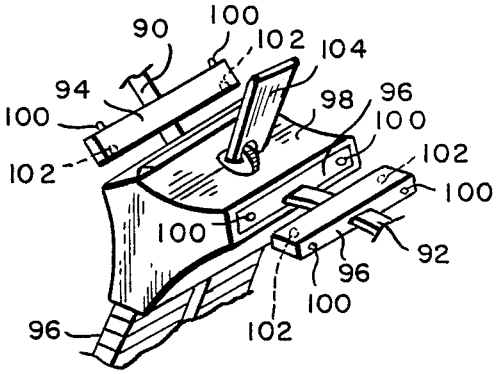
FIG. 8 is a prospective view of another embodiment of the present invention.
Figure 9:
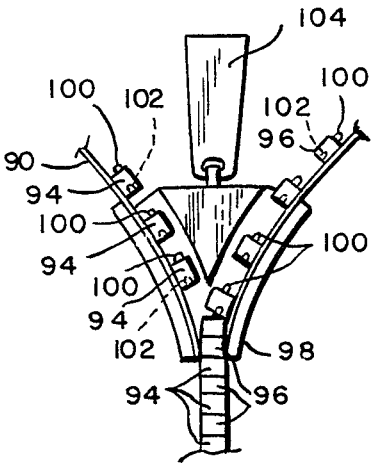
FIG. 9 is a cross-section of the embodiment of FIG. 8 taken along the line 9—9.

FIGS. 8 and 9 depict another embodiment of the present invention having two tapes 90 and 92. Links 94 and 96 are secured to the tapes 90 and 92, respectively. The links 94 and 96 are joined by passing through a slider 98 in one direction and are disjoined by passing through the slider in the other direction. The links are provided with teeth 100 which correspond with recesses 102 to interlock the links when joined by passage through the slider 98. A handle 104 is secured to the slider to promote ease if use of the slider.

It will be appreciated that, when the links are joined, an elongated column with the links 94 interspersed with the links 96 is formed. This provides a means for forming a linear support or for joining two pieces of material.

It will be appreciated that the invention affords the users thereof a means for providing an easy-to-assemble collapsible support which can readily be transported and stored, as the tapes with the links thereon can be folded, rolled or otherwise stored. The slider is also a relatively compact unit which can also be easily stored with the tapes. It will be appreciated that, as in most slide fasteners, stops and like members may be incorporated and used with this invention to improve the ease of use in various applications. Further, the interlocking means is not limited to the tooth aperture arrangement disclosed and used herein, as most interlocking or securing means use in slide fasteners would be appropriated.

This invention accordingly provides means for easily joining three separate things together. It also provides a means for providing a structural support which can be directly attached to the article to be supported. For example, the present invention provides a means whereby the linkages can be attached to a tent so that by interlocking the linkages the tent is supported thereby. It will be appreciated that the tent can be transported, disassembled and stored without having separate poles and the like.

It should also be apparent to those skilled in the art that fasteners according to the present invention may be made having more than three sides, as in certain uses it may be desirable to provide multiple means for joining. The slider disclosed herein may of course be modified in an obvious manner.

What is claimed as new and desired to be secured by Letters Patent of the United States is:

1. A slide fastener comprising:

(a) at least three flexible columns;

(b) a plurality of elongated elements are secured in a preselected manner to each of said columns;

(c) each of said elements having a first and second extending portions which have end regions and extend in a first and second direction from said columns to which said elements are secured;

(d) interlocking means disposed on said end regions of said elements;

(e) adjacent elements of said elements secured to each of said columns are sized and spaced to receive between said first extending portions of said adjacent elements said second extending portion of one of said elements secured to one of said other columns and to receive between said second extending portions of said adjacent elements said first extending portion of one of said elements secured to another of said other columns, such that said elements of each of said columns are interspersed with elements secured to two other of said columns;

(f) slider means for selectively interspersing and releasing said elements secured to each of said columns, whereby a bounded assembly is formed by said interspersed elements and said columns are joined thereby.

2. The fastener of claim 1 wherein said slider means interlocks one of said elements in said first column, one of said elements in said second column, and one of said elements in said third column in succession as said slider is moved in one direction with respect to said columns.

3. The fastener of claim 2 wherein said slider means, when moved in the other direction with respect to said columns, releases one of said elements in said first column, one of said elements in said column, and one on said elements in said third column in succession whereby said columns are disjoinable.

4. The fastener of claim 1 wherein said columns consist of only three columns, all of said elongated elements are identical such that the joining of said elements of said first, second, and third columns by said slider means causes each of said columns to be oriented equidistant from each of said other columns and said elements form a triangular arrangement.

5. The fastener according to claim 1 wherein each of said elongated elements secured to each column are all substantially the same length as the other elements secured to that column.

6. A fastener according to claim 5 wherein said interlocking means disposed on said elements include teeth extending from both of said end regions of one face of said elements and corresponding apertures disposed on both of said end regions of the other face of said elements opposite said teeth such that, when said elements of said columns are selectively interlocked, said teeth on one of said end regions of said elements secured to each of said columns into said apertures on one of said end regions of said elements of one of said other column and said teeth on the one end of said elements of said second column extend into said apertures on one of said end regions of said elements of another of said columns.

7. A multi-element slide fastenable structural support comprising:

(a) at least three flexible tape extentions;

(b) a plurality of links secured to each of said tape extentions;

(c) said links having a first and second portions which extend from said column to which said links are secured;

(d) a first and second interlocking means disposed on said first and second portions respectively;

(e) said first portion of said links secured to each of said columns extend in substantially one direction from said column to which said links are secured;

(f) said second portion of said links secured to each of said columns extend in substantially a second direction from said column to which said links are secured;

(g) adjacent links of each of said columns positioned to recieve between said first portion of said adjacent links said second portion of one of said links secured to one of said other columns and between said second portion of said adjacent links said first portion of one of said links secured to another of said columns;

(h) a slider for interspersing said links, whereby said adjacent links secured to each of said columns are interspersable with one of said extending portions of said links secured to said other columns disposed between said first and second extending portions of said adjacent links, respectively.

8. The structural support of claim 7 wherein said slider means has guideways through which said links pass, upon movement of said slider with respect to said tapes, said links passing through said guideways upon movement of said slider in a first direction are urged from a first disengaged position to an interlocking position and upon opposite movement of said slider said links are urged from said interlocked position to said first disengaged position.

9. The structural support of claim 7, wherein some of said elongated links are of varying thicknesses, such that the interlocking of said links causes the structure formed thereby to be curved.

10. The structural support of claim 7, wherein said first and second interlocking means include corresponding teeth and apertures positioned on opposite faces of both of said portions.

11. A method for joining a slide fastenable collapsible structural support having at least three tapes with multiple links secured thereto at pre-selected intervals, in a slider having guideways corresponding to said tapes comprising the steps of:

(A) positioning tapes in said guideways,;

(B) pulling said slider with respect to said tapes so that said links pass through said guideways; and (C) interlocking said links from each of said tapes as said links pass through said guideways, such that each of two adjacent links on each of said tapes have one link from two of said other tapes disposed between said two adjacent links contact both of said adjacent links.

12. The method of claim 11 further comprising the step of swiveling said links from a first position upon entering said guideway to a second upright position as said links pass through said guideway thereby facilitating the interlocking of said links.

13. The method of claim 12 further comprising the step of separating said links by pulling said slider in an opposite direction with respect to said tapes after said links have been interlocked whereby said links are swiveled from the second to the first position upon passing through said guideways to thereby separate said tapes.

14. A slide fastenable assembly comprising:

(a) three tapes;

(b) a plurality of elongated links secured to each of said tapes such that both ends of each of said links extend in substantially opposite directions from the tapes to which said links are secured;

(c) a slider having guideways through which said links are adapted to pass;

(d) interlocking means disposed on each end of said links;

(e) a handle secured to said slider; and (f) said guideways are adapted for positioning said links, as said links pass through said guideways, such that said links are interspersed with two adjacent links from one of said tapes having between them at one end a link from a second of said tapes and at the other end a link from the third of said tapes, whereby said links are interlocked to form said assembly having a substantially triangular cross-section.

15. The assembly of claim 14 wherein said interlocking means are teeth disposed on one face of each end of said links and corresponding recesses on the opposite face of each end of said links.

16. The assembly of claim 15 wherein said guideways urge said links from a first position to a second position as said links pass therethrough, whereby said links can be joined and disjoined.

* * * * *